United States Patent [19]

Rudy, Jr. et al.

[11] Patent Number: 4,804,342

[45] Date of Patent: Feb. 14, 1989

[54] CABLE STRAIN RELIEF FOR MODULAR CONNECTOR

[75] Inventors: William J. Rudy, Jr., Annville; Howard R. Shaffer, Millersburg; Daniel E. Stahl, Dauphin, all of Pa.

[73] Assignee: AMP Incorporated, Harrisburg, Pa.

[21] Appl. No.: 42,203

[22] Filed: Apr. 24, 1987

[51] Int. Cl.[4] ..... H01R 13/58

[52] U.S. Cl. ..... 439/467; 439/470

[58] Field of Search ..... 439/465, 467, 470, 471, 439/472, 498

[56] References Cited

U.S. PATENT DOCUMENTS

| | | | |
|---|---|---|---|
| 3,054,081 | 9/1962 | Bertram et al. | 439/467 |
| 3,148,928 | 9/1964 | Noschese et al. | 439/472 |
| 3,432,802 | 3/1969 | Ritchie | 439/465 |
| 3,854,787 | 12/1974 | Snyder, Jr. | 339/103 R |
| 4,173,388 | 11/1979 | Brandeau | 339/276 T |
| 4,269,466 | 5/1981 | Huber | 339/107 |
| 4,451,099 | 5/1984 | Bricker, Jr. et al. | 339/14 R |
| 4,596,432 | 6/1986 | Tighe, Jr. | 339/107 |

*Primary Examiner*—Eugene F. Desmond
*Attorney, Agent, or Firm*—Anton P. Ness

[57] ABSTRACT

A cable strain relief assembly has a first cover (30, 180) fastenable to a cable face (26) of an electrical connector (20) having an array (28) of cables (22) extending therefrom such that the cable array (28) extends over a transverse aperture (50, 184) near the rearward end (36) of the first cover (30, 180). The second cover (80, 182) is securable over the cable array (28) to the first cover (30, 180) at their rearward ends (36, 86) in a manner clamping the cables (22) into the aperture and against surfaces (52, 54, 190) adjacent the forward (56) and rearward (58) sides of the aperture (50, 184). In one embodiment, the second cover (80) has a pair of hooks (90) which hook around a pair of cylindrical bosses (60) at each side of the cable array (28) and just rearwardly of the aperture (50), and the second cover (80) is then rotatable with the hooks (90) and bosses (60) comprising a pivot unit a clamping surface (102) of the second cover (80) engages the cables (22) and deflects portions of them into the aperture (50) and clamps them against the adjacent surfaces (52, 54) whereupon the second cover (80) is fastened to the first cover (30) such as by latch members (68) and bosses (60). In another embodiment the second cover (182) is a clamping bar received and latched into the aperture (184) deflecting and clamping portions (194) of the cables against adjacent surfaces (190).

18 Claims, 7 Drawing Sheets

CABLE STRAIN RELIEF FOR MODULAR CONNECTOR

FIELD OF THE INVENTION

This invention relates to the field of electrical connectors and more particularly to strain relief assemblies therefor.

BACKGROUND OF THE INVENTION

Conventional strain relief methods are known to clamp a plurality of conductor cables together in a bundle tightly to rearwardly portions of connector housings so that strain on the conductor cables from remote of the connector is relayed to the connector housing. This relief minimizes the stress on each or any of the terminations of the terminals to the conductor wires within the cable, or to the stress of the terminals on their retention mechanism within respective passageways in the housing.

It is desired to provide a strain relief for a planar array of conductor cables extending from a narrow elongated connector such as a single-row module stacked side-by-side to adjacent similar modules closely spaced to economize on spacing between the rows of terminals, wherein the strain relief means including the means fastening it to the connector is no wider or longer than the module.

It is further desired to provide such a strain relief for a narrow connector which resists forces tending to apply a torque on the strain relief in a direction relative to the connector normal to the elongate dimension of the connector.

It is also further desirable to provide a strain relief assembly of few parts and capable of ease of assembly and disassembly.

SUMMARY OF THE INVENTION

The present invention provides an assembly for strain relief of an array of cables extending from an electrical connector. A first cover is securable at a forward section to the cable face of the connector at both ends of the array of cables and has a transition section which gathers the cables close together to be clamped into a transverse aperture in the rearward section of the first cover. A second cover has a cable clamping portion associated with the transverse aperture and is adapted to engage and deflect the cables into the aperture when the second cover is secured to the first cover, in a manner which firmly presses the deflected cable portions against surfaces of the cable side of the first cover adjacent forward and rearward side of the aperture.

According to one embodiment of the present invention, the cable facing side of the first cover has a pivot means such as a pair of bosses on both sides of the rearward section just rearwardly of the aperture which have bearing surfaces cylindrical about a common axis transverse of the first cover with the bearing surfaces facing forwardly and inwardly. The second cover has a corresponding pair of C-shaped hooks with aligned cylindrical inside bearing surfaces, with the hooks opening away from the cable facing side. The hooks are insertable under the bosses, and the second cover is rotated about the axis of the bosses with the clamping surface engaging and deflecting the cables into the aperture and upon full clamping the second cover is secured to the first cover proximate their forward ends such as by latches.

According to another embodiment of the present invention, the second cover essentially comprises a clamping bar receivable into the aperture of the first cover, and against deflecting the cables thereinto and clamping them against the first cover at forward and rearward sides of the aperture, with the clamping bar being latched when fully inserted into the aperture such as by latching ledges at ends of the aperture entering into latching recesses at ends of the clamping bar.

According to another aspect of the present invention, the means for fastening the first cover to the connector can comprise flanges at both ends of the forward section, clip members having transverse rear sections extending across rear surfaces of the flanges, having axially extending body sections and having transverse forward sections extending into transverse slots in the connector, and pins insertable through aligned holes in the flanges, the rear clip sections, the connector and the forward clip sections. The pins have enlarged rear heads and may have bifurcated enlarged forward ends capable of being squeezed to pass through a smaller diameter hole in the forward clip section and then reenlarge in a larger diameter portions of the connector hole forwardly of the forward clip sections, with the forward clip sections now acting as stop members with regard to the enlarged forward pin ends, securing the pins in the holes and fastening the first cover to the connector.

It is objective to provide a means for strain relief for a planar array of cables extending from a single row connector module adapted to be stacked side-by-side with other like modules with the strain relief assembly likewise having to be capable of being side-by-side with like strain relief assemblies of adjacent stacked modules.

It is another objective of the present invention to provide a strain relief assembly having few parts and capable of swift and simple assembly.

DETAILED DESCRIPTION OF THE PREFERRED EMBODIMENT

Figure 1:
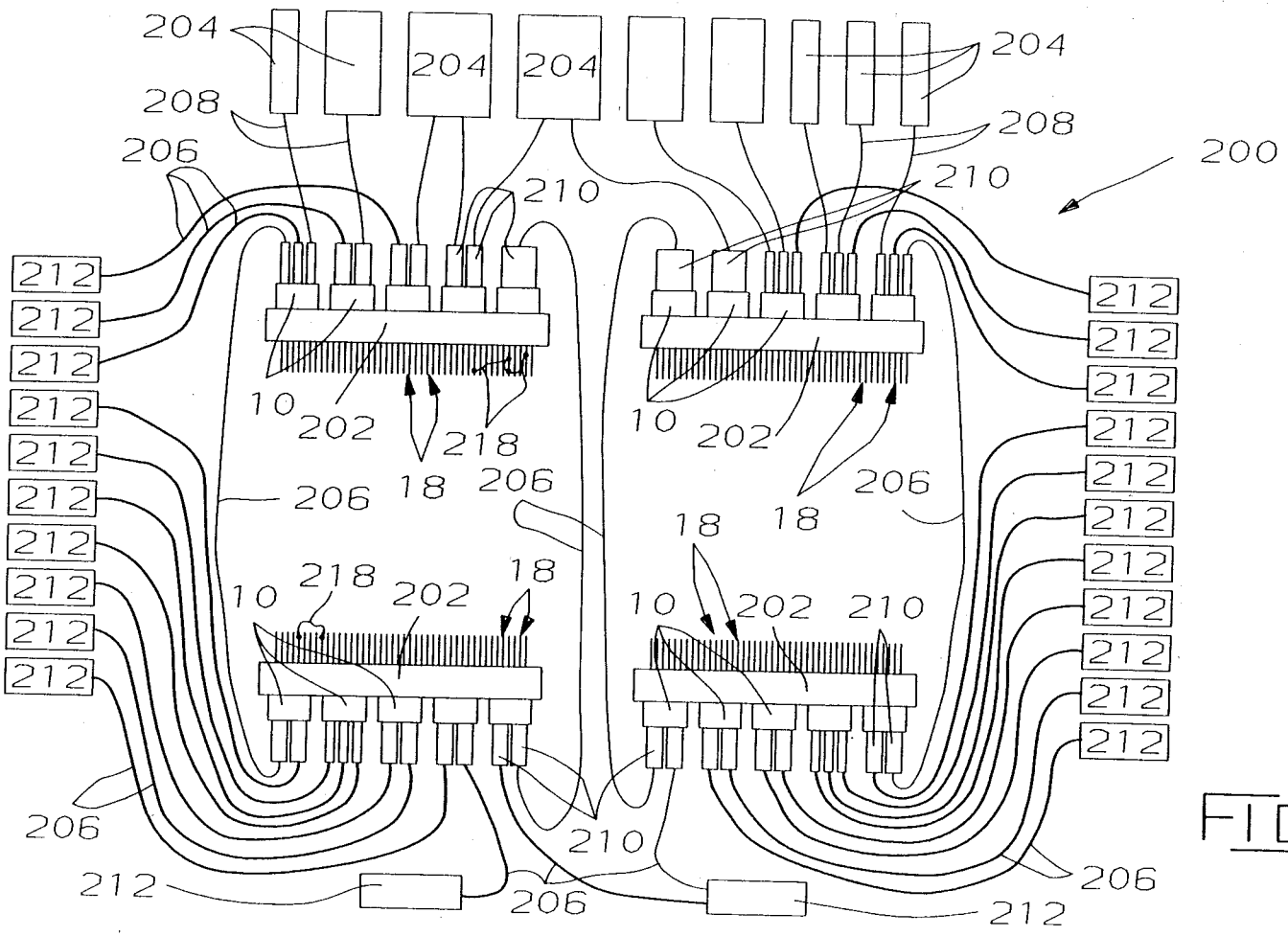
FIG. 1 and 2 are schematic and perspective views of a wire integration system with which the present invention may be used.
Figure 2:
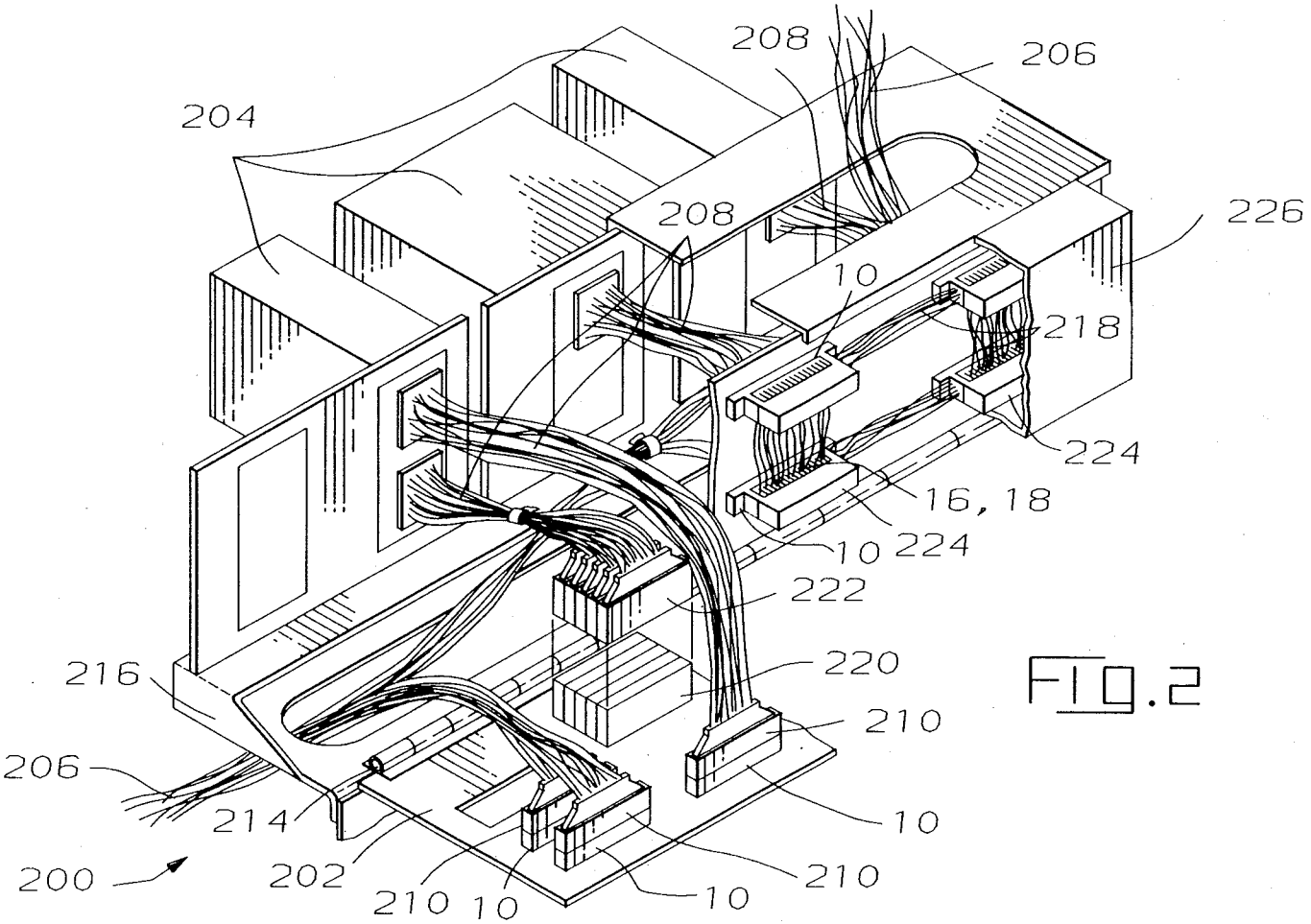

FIGS. 1 and 2 illustrate a wire integration system 200 such as for use on aircraft where a plurality of shipboard systems including power, control, detection, indication, radio reception and transmission and so on must be interconnected or "integrated" at one or more wire integration panels 202 with other such systems. Such systems must be capable of being controlled or sensed at a central location or electrical/electronics bay by a plurality of "black boxes" 204 and also be capable of being interconnected with each other as desired. The black boxes must be capable of removal from the aircraft such as for frequent routine testing and maintenance, or for replacement. Cables 206,208 generally are arranged in bundles or hardnesses terminated at one end by modular plug connectors 210 which extend to a wire integration panel 202 on which are mounted receptable connectors 10 matable at one face of the panel with plug connectors 210. Mating receptable connectors 10 and plug connectors 210 are shown having two rows of terminals; a receptacle connector 220 and a plug connector 222 are shown ready to be mated and having five rows of terminals, for example, illustrating the modular capability of wire integration system 200.

Along the face of the panel opposed from the face receiving plug connectors 210, in the embodiment shown, terminals 16 of receptacle connectors 10 are secured in housings 12 and have wire wrap posts 18 extending outwardly therefrom for one or more electrical conductor wires 218 to be wrapped for electrical connection to corresponding one or more terminals of respective one or more electrical systems as desired. Preferably post protectors 224 are secured over the wire wrap arrays, and a cover plate 226 is mounted to the panel for additional protection.

The other ends of cables 206 are electrically connected with shipboard systems 212 or another wire integration panel 202, while the other ends of cables 208 are electrically connected to black boxes 204. The mating plug and receptacle connector assemblies 210,10 must be modular and panel mountable; be uniquely keyed; be easily latchable upon mating in an aligned, keyed and polarized manner; and be easily delatchable. Integration panel 202 can have receptacle connectors 10 mounted thereto and automatically or semi-automatically wired as a total subassembly and tested prior to installation into the aircraft, and also can be removed from the aircraft for testing, repair or replacement if necessary. Panel 202 is hinged at hinge 214 to be lowered forwardly from a supporting structure 216 for easy access to the rearward face of the panel. This access facilitates programming and reprogramming which is essential in order to adapt an aircraft of otherwise standard manufacture to meet the avionic requirements of specific customer airlines.

Figure 3:
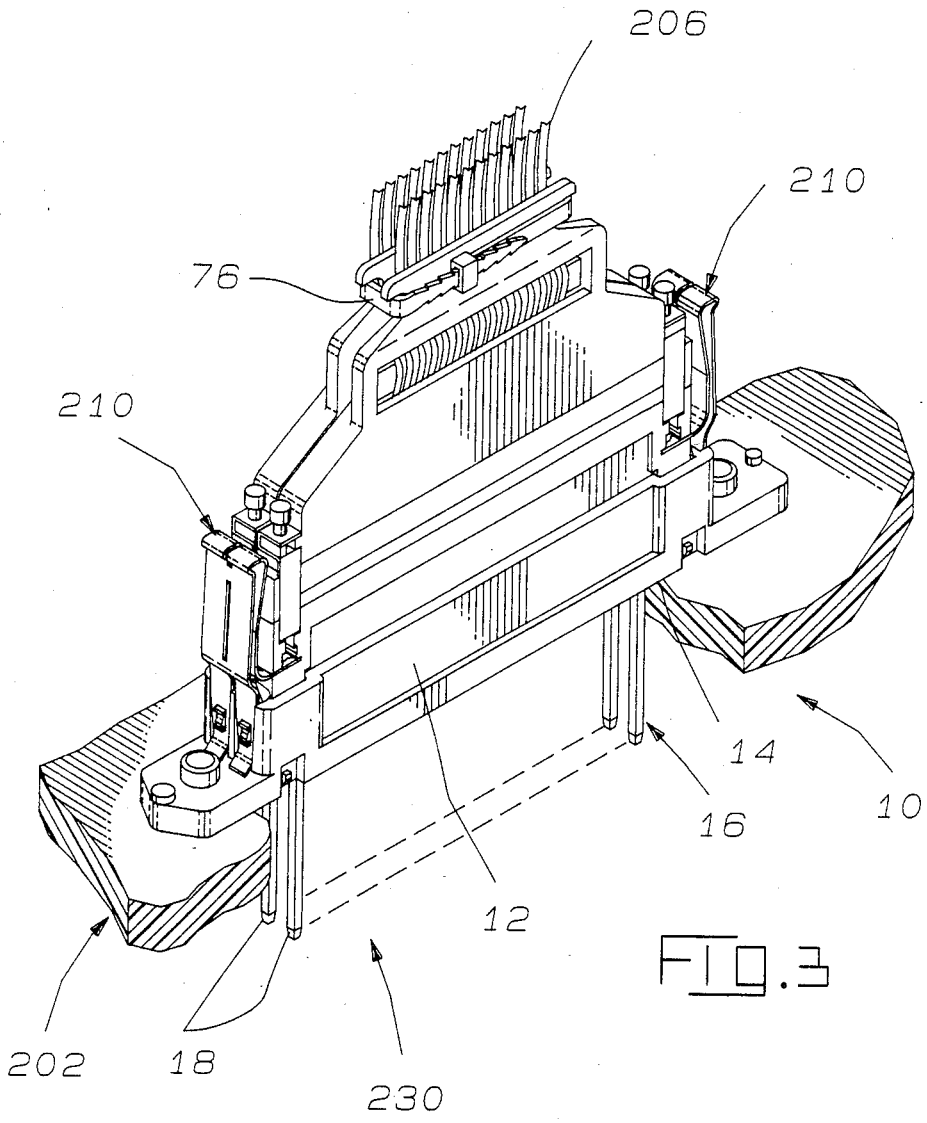
FIG. 3 is a perspective view of mated plug and receptacle connectors for use in a wire integration panel of the system of FIGS. 1 and 2.

FIG. 3 shows a two-row plug connector 210 to mate with the mating face of a two-row receptacle connector 10 mounted to integration panel 202 of FIG. 2, with an array of wire wrap posts 18 of terminals 16 extending from a wire wrap face 14 of the receptacle connector 10. Such a mating connector system 230 for the wire integration system 200 of FIGS. 1 and 2 is described with more particularity in U.S. Pat. Nos. 4,762,507; 4,735,583; 4,726,791; and 4,752,248 and patent application Ser. No. 07/042,495 filed Apr. 24, 1987, now U.S. Pat. No. 4,778,411, and all assigned to the assignee hereof.

The present invention is an assembly for securing to a cable-receiving face of each single-row plug connector module 20 of a plug connector 210 of FIG. 3, to provide strain relief to cables 22 of each module 20 in a manner not interfering with stacking or ganging the modules together to form a plug connector. Each cable 22 has its conductor terminated by a terminal (not shown) and is then secured in a terminal-receiving passageway 24 by conventional means such as retention clips (not shown) secured in the passageway rearwardly of the terminal. Strain relief is necessary to intercept strain on one or more of the cables which otherwise would tend to pull the conductor wire rearwardly away from the secured terminal and destroy or damage the termination.

Figure 4:
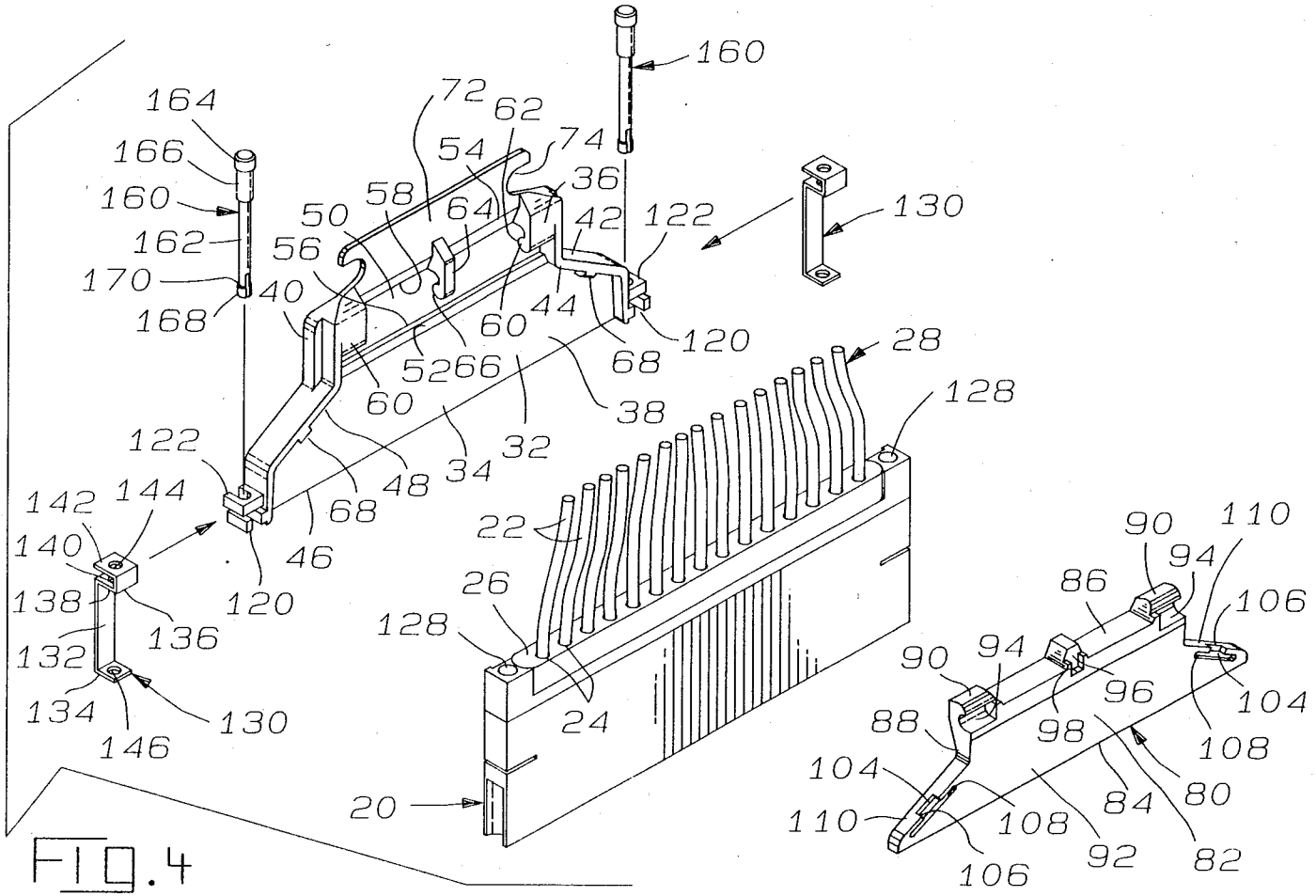
FIG. 4 is a perspective exploded view of a first embodiment of the strain relief assembly of the invention.

FIG. 4 illustrates the preferred embodiment of the strain relief assembly of the present invention. Connector module 20 has a single-row array of conductor cables 22 extending rearwardly from laterally spaced passageways 24 and away from cable face 26. First strain relief cover 30 is preferably molded of thermoplastic dielectric material such as amorphous polyetherimide and has a planar body section 32 extending from a forward section 34 to a rearward section 36, and generally having a cable side 38 and an outer surface 40. Along lateral sides 42 side walls 44 extend away from cable side 38 of body section 32. At forward end 46 cover 30 has major and minor dimensions about equal to those of connector module 20 while rearward section 36 of cover 30 is reduced in dmension to be just wide enough for cables 22 to extend therefrom closely spaced side-by-side; transition section 48 is disposed between forward section 34 and rearward section 36 in which cables 22 are gathered close together.

Rearward section 36 includes large transverse aperture 50 whereat cables 22 will be clamped to provide strain relief. Aperture 50 has a transverse dimension large enough to be wider than the width of cable array 28 when cables 22 are gathered clsoely together. Aperture 50 preferably has an axial dimension equal to from about three cable diameters to five cable diameters. Surface portions 52,54 of cable side 38 of cover 30 adjacent forward side 56 and rearward side 58 of aperture 50 are preferably gently tapered to comprise cable-engaging surfaces against which cables 22 will be clamped.

Rearward section 36 further includes a pair of bosses 60 along rearward side 58 of aperture 50 at each lateral side thereof and spaced from cable side 38. Bosses 60 comprise a pivot means for second cover 80 and have preferably cylindrical bearing surface portions 62 facing forward end 46 and aperture 50 and being aligned with each other to define a transverse axis about which second cover 80 will be rotated.

Figure 5A:
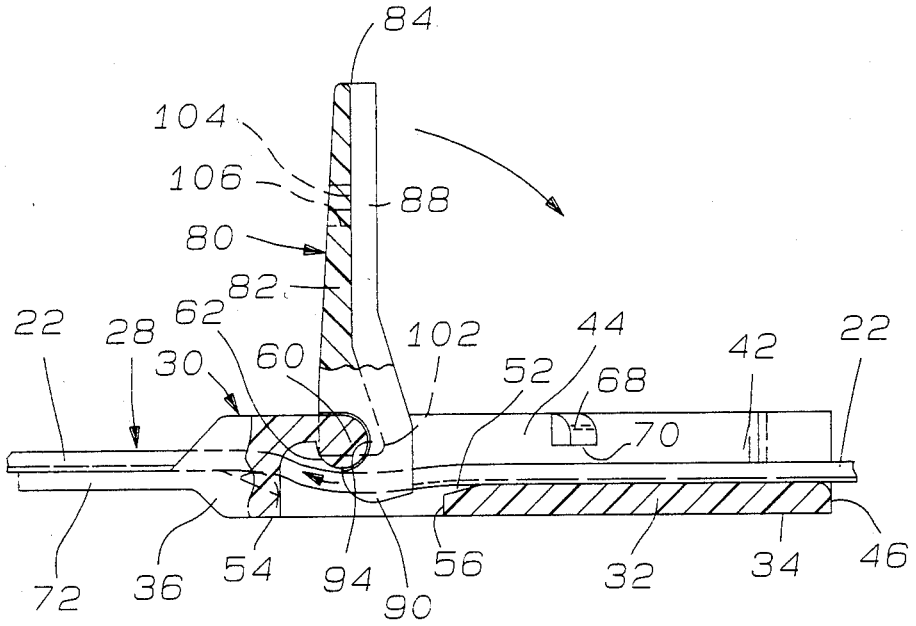
FIGS. 5A and 5B are longitudinal section views of the strain relief assembly of FIG. 4 in an open position, and in a closed position clamping the cables.

Second cover 80 is preferably molded of thermoplastic dielectric material such as amorphous polyetherimide and has a planar body section 82 extending from a forward end 84 to a rearward end 86 and which includes side walls 88. Along rearward end 86 at each side is a C-shaped hook 90 having its opening facing away from outer surface 92 of body section 82. Within each hook 90 is a substantially cylindrical inner bearing surface 94. Hooks 90 correspond with bosses 60 of first cover 30 and their cylindrical inner bearing surfaces 94 define a transverse axis. Hooks 90 are adapted to be inserted under respective bosses 60 during assembly when second cover 80 is manipulated to extend outwardly from first cover 30 approximately perpendicularly thereto, first cover 30 being adapted to provide clearance under bosses 60 to receive hooks 90 insertably thereunder as shown in FIG. 5A. Central boss 64 of first cover 30 is placed between bosses 60 and provides rigid support for the central portion of second cover 80 upon engagement of its inwardly facing surface 66 with support surface 96 within central recess 98 of second cover 80 along rearward end 86, to prevent the central portions of first and second covers 30,80 from being forced apart upon clamping engagement with cable array 28 at aperture 50.

Figure 5B:
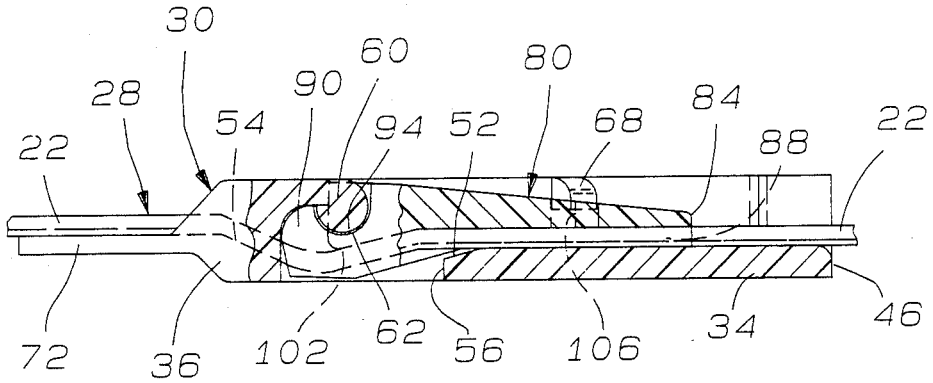

Referring to FIGS. 5A and 5B, first cover 30 has been fastened to connector module 20 preferably in a manner described below, and cables 22 have been gathered closely together into a planar cable array 28 proximate aperture 50. Hooks 90 of second cover 80 have been inserted under bosses 60 with body section 82 held approximately perpendicularly to first cover 30. Cable side 100 of second cover 80 includes a clamping surface portion 102 which will engage cable array 28 and cam against portions thereof deflecting them into aperture 50 as second cover is rotated about the transverse axis defined by bosses 60; second cover body section 82 comprises a lever arm long enough to facilitate manual rotation which overcomes the resistance to deflection by cable array 28. Clamping surface 102 firmly holds portions of cables 22 against tapered surface portions 52,54 forwardly and rearwardly of aperture 50 when second cover 80 has been fully rotated.

Upon full rotation, as in FIG. 5B, second cover 80 is secured to first cover 30 by fastening means such as preferably by means of a pair of latch members 68 of walls 44 along transition section 48 of first cover 30. Latch members 68 have latch surfaces 70 facing away from second cover 80 and engage corresponding latch surfaces 104 with recesses 106 along lateral side walls 88 of second cover 80. To facilitate latching, second cover 80 preferably includes long relief apertures 108 in planar body section 82 along side walls 88 near forward end 84 which enable portions 110 of side walls 88 to be deflected thereinto during latching to ride over latch members 68, after which the deflected wall portions 110 resile for latch surfaces 104 to latch under latch surfaces 70 of latch members 68. It is believed that second cover 80 need not tightly engage cables 22 proximate forward end 84 after latching. It is believed that if strain is applied to the cables, the strain will tend to induce second cover 80 to rotate further about bosses 60, and hence tend to assist securing of second cover 80 to first cover 30. Rearward section 36 of first cover 30 includes an extended portion 72 having lateral recesses 74 to facilitate securing a cable tie 76 (FIG. 3) when a plurality of connector modules 20 have been ganged together, to bundle their cable arrays together. Placement of a cable tie to portion 72 can be effectively used where a cable is a tri-lead cable (not shown) having several separate conductor wires within an outer jacket, where between the cable tie 76 and clamping aperture 50 the outer jacket may be removed and the three conductor wires may be separately clamped in aperture 50.

Figure 6:
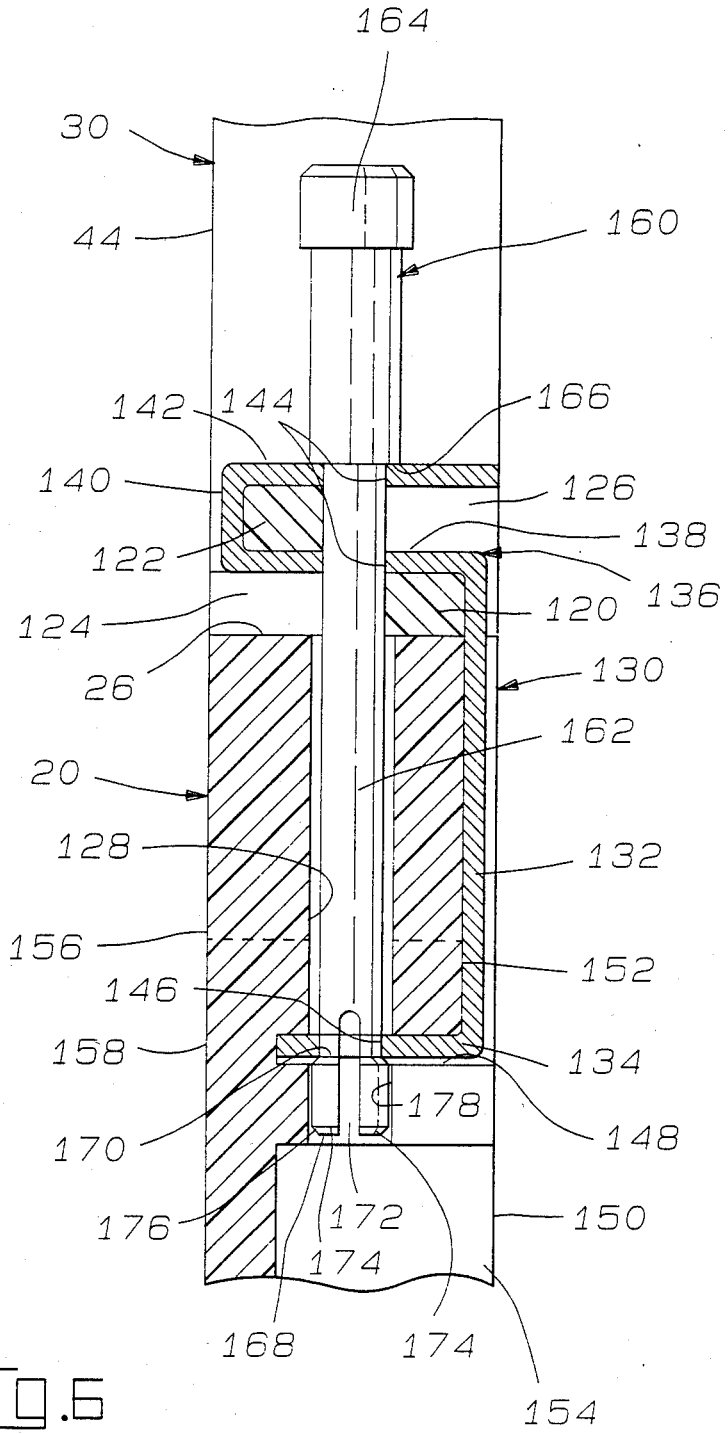
FIG. 6 is an enlarged longitudinal section view of one of the sets of fastener clips and pins securing a strain relief cover to the connector.

In FIG. 6 is shown the preferred means of fastening first cover 30 to connector module 20. First and second flanges 120,122 extend laterally outwardly from each side wall 44 at forward end 46. Flanges 120,122 contain pin-receiving apertures 124,126 respectively, which because of the two-draw molding process extend inwardly from sides thereof, with overlapping aperture bottoms for receipt of a pin axially therethrough. The axis through flange apertures 124,126 aligns with pin-receiving holes 128 extending into module 20 from cable face 26. Each metal fastener clip 130 has an elongated body section 132, a transverse forward section 134, and a rearward section 136. Rearward section 136 comprises a first transverse section 138 to extend behind first flange 120, a short axial portion 140 to extend along a side surface of second flange 122, and a second transverse section 142 to extend along the rearward surface of second flange 122. Through transverse sections 138,140 extend holes 144 which are located to align with flange apertures 124,126 and module hole 128. Forward clip section 134 also includes hole 146 slightly smaller in diameter than module hole 128. Module 20 includes slot 148 extending transversely thereinto from side surface 150 and intersecting module hole 128, and slot 148 receives forward clip section 134 thereinto from side surface 150 such that smaller diameter clip hole 146 is in axial alignment with module hole 128. Module side surface 150 includes a channel 152 rearwardly from slot 148 along which clip body section 132 will be disposed. Module hole 128 is shown in axial communication with a larger forward cavity 154 not related to the fastening means but used in connection with retention of a module key member, as disclosed in above-mentioned Application Ser. 07/042,495. A rearward module portion 156 is shown secured by bonding to main module housing portion 158 of module 20 which is used to secure terminal retention clips (not shown) in large diameter rearward portions of the terminal passageways. Slot 148 is located in main module housing portion 158 so that fastener clip 130 relays stress on the cables to main module housing portion 158.

A pin 160 is insertable through all aligned holes and apertures at the respective fastening location to secure first cover 30 to module 20 using clip 130. Pin 160 comprises an elongated shaft 162, an enlarged rearward heat 164 for gripping thereof, a forwardly facing stop shoulder 166 near rearward head 164, and an enlarged forward end 168 defining a rearwardly facing stop shoulder 170 so located to be axially forwardly of forward clip section 134 when rearward stop shoulder 166 is axially rearwardly of second transverse clip section 142 when assembled. Enlarged forward end 168 has an outer dimension small enough to be capable of being received through rearward clip holes 144, flange apertures 124,126 and module hole 128, but larger than the diameter of forward clip hole 146. Enlarged forward end 168 is bifurcated by slot 172 extending thereinto from the front which creates a pair of end portions 174 deflectable toward each other to pass through smaller diameter forward clip hole 146, and forward end 168 has a beveled periphery comprising a lead-in 176 to facilitate inward deflection of end portions 174 by sides of forward clip hole 146. Upon passing through hole 146, end portions 174 enter a forward portion 178 of module hole 128 and resile when stop shoulder 170 becomes situated forwardly of forward clip section 134, thus defining a stop means preventing axially rearward movement of pin 160 and securing itself to module 20 and thereby securing first cover 30 to module 20. It may also be preferable to provide a slightly taper to rearward facing stop surface 160 on enlarged forward end 168 to facilitate disassembly.

The fastening arrangement provides resistance to forces perpendicular to the plane of body section 32 of first cover 30 which would tend to induce a torque on first cover 30 with respect to module 100; forces applied relatively against outer cover surface 40 will cause side surfaces of flanges 120,122 to engage axial clip sections 132,140 respectively, while forces applied in the opposite direction will cause bottoms of apertures 124,126 to engage shaft 162 of pin 160.

Figure 7:
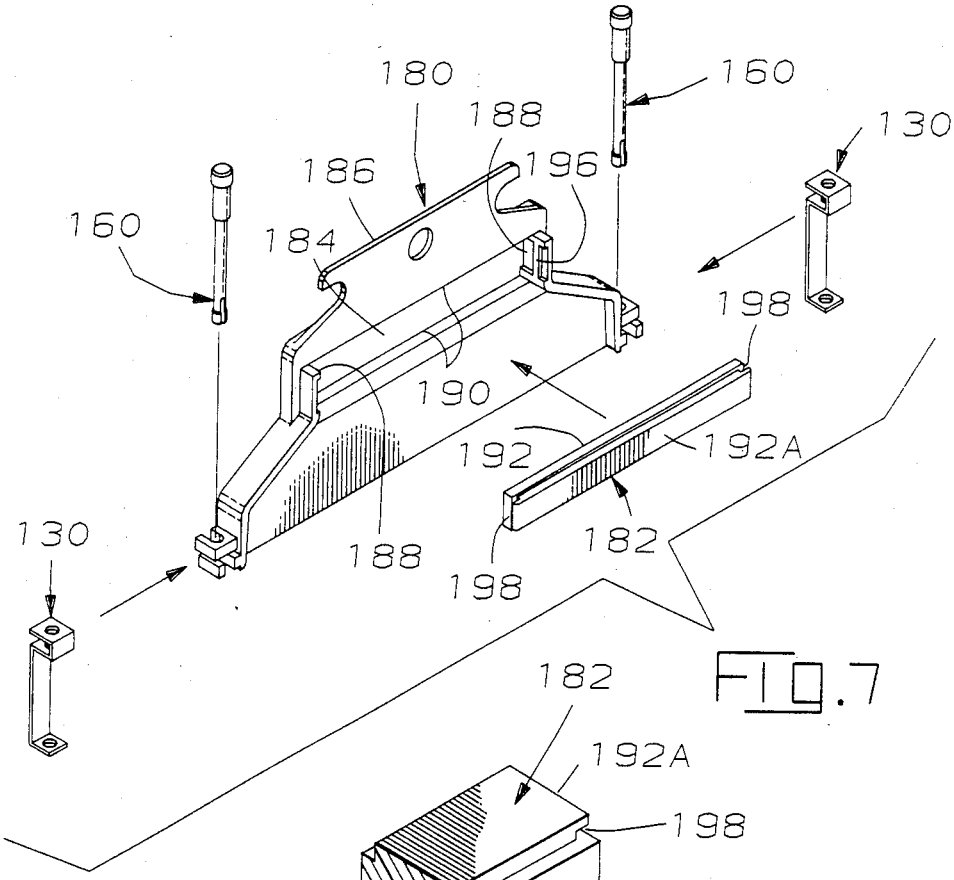
FIG. 7 is a perspective view of a second embodiment of the present invention.
Figure 8:
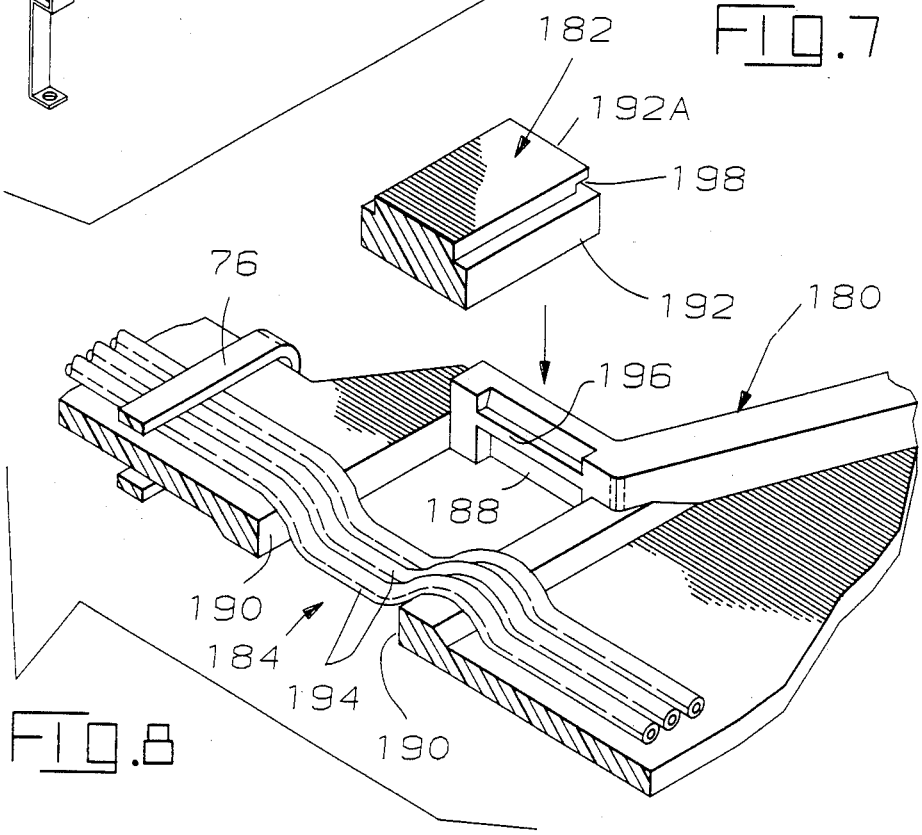
FIG. 8 is an enlarged section view of the embodiment of FIG. 7 with a second cover exploded from the first cover aperture.

Referring to FIGS. 7 and 8, there is shown another embodiment of a strain relief assembly having a first member 180 and second member 182. First member 180 is similar to first cover 30 of FIG. 4 and is securable to a connector module identically to the manner in which first cover 30 is secured. First member 180 has a cable-receiving aperture 184 proximate rearward end 186 which extends transversely between lateral sides 188 a sufficient dimension to receive the cable array thereacross from forward to rearward aperture sides 190. Second member 184 includes an elongate clamping boss 192 dimensioned to be received in aperture 184 along with portions 194 of the cables. Boss 192 has an axial dimension selected to be less than the axial dimension of aperture 184 by about two cable diameters, because boss 192 will deflect cable portions 194 into aperture 184 to firmly clamp them against forward and rearward aperture sides 190 when second member 182 is urged against cable portions 194 during assembly.

Second member 182 can be secured to first member 180 by means of latching ledges 196 disposed along lateral sides 188 of aperture 184 which seat latchingly into latching recesses 198 behind clamping boss 192 of second member 182 upon full insertion into aperture 184, clamping cable portions 194 thereinto. Latching edges 196 can be disposed on aperture wall portions thin enough to be deflected outwardly during insertion of clamping boss 192 thereinto or more preferably, ledges 196 can be temporarily flattened as boss 192 with a radiussed leading edge passes thereover, first member 180 being preferably molded of plastic material having enough resilient, and ledges 196 being dimensioned small enough, to withstand such elastic deformation.

Second member 182 can even comprise just a clamping boss, as shown in FIG. 7, and can actually have a second clamping boss 192A opposed from boss 192 and dimensioned axially to accommodate different diameter cables while maintaining the same transverse dimension as boss 192 and defining latching recesses 198 therebetween.

Other variations and modifications may be made to the embodiments described herein which will be within the spirit of the invention and the scope of the claims.

What is claimed is:

1. A cable strain relief assembly for an electrical connector having extending therefrom a plurality of electrical conductor cables terminated to terminals of the connector, for relieving strain on the terminations transmitted by the array of conductor cables, comprising:

first cover means joined to a connector and extending rearwardly from a cable face of said connector at least along a first major side of an array of conductor cables extending rearwardly from said connector cable face, said first cover means including a forward end at said cable face, a rearward end and lateral sides, and further including a cable side and an outer surface opposed therefrom; and second cover means to be disposed along a second major side of said cable array opposed from said one major side and having a forward end, a rearward end, lateral sides, a cable side and an outer surface opposed therefrom;

said first cover means including a pivot means along said cable side proximate said rearwardly end thereof, and said second cover means including hook means proximate said rearward end thereof associated with and pivotable around said pivot means in bearing engagement therewith during securing of said second cover means to said first cover means, said second cover means including a clamping surface portion on said cable side adapted to be cammed into engagement with said cable array disposed between said first and second cover means upon securing thereof together, whereby said cable array is clamped by said clamping surface portion against cable-engaging portions of said first cover cable side substantially opposed therefrom when said second cover means is pivoted from a first orientation not engaged with said cable array to a second orientation clampingly engaging said cable array.

2. A cable strain relief assembly as set forth in claim 1 wherein said pivot means comprises a pair of bosses spaced apart near said lateral sides of said first cover means and on both sides of said cable array, said bosses having outer bearing surface portions substantially cylindrical about a common axis and disposed on sides of said bosses facing at least toward said outer surface of said first cover, and said hook means comprises a pair of hooks similarly spaced apart near said lateral sides of said second cover means, said hooks having inner bearing surface portions substantially cylindrical about a common axis, and said hooks being C-shaped open toward said outer surface of said second cover means, said first cover means being adapted to receive free ends of said hooks inserted under and partially around respective said bosses from forwardly thereof during securing of said second cover means to said first cover means.

3. A cable relief assembly as set forth in claim 2 wherein said first cover means includes a rigid support means substantially centered between said bosses and extending outwardly from said cable side and then forwardly to be engaged underneath by and rigidly bear against corresponding bearing means of said second cover means at a central location whereby central portions of said clamping surface portion and said corresponding said opposed cable-engaging portions are maintained in clamping engagement with said cable array at said central location.

4. A cable strain relief assembly as set forth in claim 1 further including fastening means disposed proximate respective said forward ends of said first and second cover means to secure said first and second cover means in a fastened condition when said second cover means has been rotated to said second orientation clamping said cable array against said first cover means.

5. A cable strain relief assembly as set forth in claim 4 wherein said fastening means comprises a pair of integral latch members of one of said first and second cover means proximate said forward end and disposed along lateral sides thereof adapted to latch over a corresponding latching surface means of the other of said first and second cover means.

6. A cable strain relief assembly as set forth in claim 5 wherein said latching surface means is disposed on a deflectable wall portion along a respective said lateral side of said other of said first and second cover means, said deflectable wall portion being deflectable inwardly into a relief aperture of said other of said first and second cover means by said latch member when being urged therepast during fastening of said first and second cover means.

7. A cable strain relief assembly as set forth in claim 1 wherein said cable-engaging portions of said first cover means comprise surface portions of said cable side adjacent a transverse cable-receiving aperture through said first cover means proximate said rearward end thereof and opposed from said clamping surface portion of said second cover means, said aperture having a transverse dimension at least as wide as said cable array proximate said rearward end of said first cover means, said adjacent surface portions being tapered, whereby said clamping surface portion of said second cover means engages and deflects engaged portions of said cables of said cable array into said cable-receiving aperture and firmly against said cable-engaging adjacent surface portions of said first cover means when said second cover means is rotated from said first orientation to said second orientation.

8. A cable strain relief assembly as set forth in claim 1 wherein said rearward end of said first cover means is narrower than said forward end thereof and said first cover means includes a transition section therebetween, whereby said first cover means receives said cables of said cable array spaced apart at said cable face of said connector and gathers said cables closely together in a planar array within said transition section to facilitate clamping of said cable array proximate said rearward end of said first cover means.

9. A cable strain relief assembly as set forth in claim 1 wherein said first cover means includes means at said rearward end to be engaged by a cable bundling means to facilitate bundling of said cable array with adjacent cable arrays of adjacent connectors.

10. A cable strain relief assembly as set forth in claim 1 wherein said first cover means is a separate member securable by securing means to said connector.

11. A cable strain relief assembly for an electrical connector having extending therefrom a plurality of electrical conductor cables terminated to terminals of the connector, for relieving strain on the terminations transmitted by the array of conductor cables, comprising:

first cover means joined to a connector and extending rearwardly from a cable face of said connector at least along a first major side of an array of conductor cables extending rearwardly from said connector cable face, said first cover means including a forward end at said cable face, a rearward end and lateral sides, and further including a cable side and an outer surface opposed therefrom; and second cover means to be disposed along a second major side of said cable array opposed from said one major side and having a forward end, a rearward end, lateral sides, a cable side and an outer surface opposed therefrom;

said second cover means being securable by second securing means to first securing means of said first cover means proximate said rearward end of said first cover means and having means along said cable side thereof adapted to engage said cable array along said cable side thereof adapted to engage said cable array along said second major side thereof and clamp said array against said cable side of said first cover means upon being secured to said first cover means;

said first cover means includes a transverse cable-receiving aperture therethrough proximate said rearward end having a transverse dimension at least as wide as said cable array thereat, and said first securing means are disposed along lateral sides of said aperture;

said clamping means of said second cover means comprises a boss having a transverse dimension just less than said transverse dimension of said aperture and having a short axial dimension, and said second securing means of said second cover means are disposed along lateral sides of said clamping boss;

said transverse aperture has an axial dimension just larger than an amount equal to said short axial dimension of said clamping boss of said second cover means plus twice the diameter of the cables of said cable array, whereby when said clamping boss engages said cable array at said transverse aperture and said second cover means is urged toward said first cover means and against said cable array, said clamping boss deflects engaged portions of said cables of said cable array into said aperture and firmly against forward and rearward sides thereof, and said clamping boss is received within said aperture such that said first and second securing means engage and secure said second cover means to said first cover means thereby clamping said cables.

12. A cable strain relief assembly as set forth in claim 11 wherein said first cover means is a separate member securable by securing means to said connector.

13. A cable strain relief assembly as set forth in claim 11 wherein said second securing means comprises a latching recess at each lateral side of said clamping boss having a stop surface facing said outer side, said first securing means comprises a latching ledge at each lateral side of said aperture cooperable with a respective said latching recess, and said first cover means being adapted so that said lateral sides of said aperture are compliant permitting a leading portion of said clamping boss to pass over said latching ledges prior to said latching ledges entering respective said latching recesses.

14. A cable strain relief assembly as set forth in claim 13 wherein said first cover means is molded of material of sufficient resilience to permit said latching ledges to be temporarily deformed laterally outwardly to permit said leading portion of said clamping boss to pass thereover.

15. A cable strain relief assembly as set forth in claim 13 wherein said second cover means comprises said clamping boss.

16. A cable strain relief assembly as set forth in claim 15 wherein said second cover means includes a second boss extending outwardly from said outer surface and having a transverse dimension equal to that of said clamping boss and defining said latching recesses therebetween, and said second boss has selected a short axial dimension different from that of said clamping boss, whereby said second boss defines a clamping boss capable of clamping cables of a different diameter into said transverse aperture of said first cover means when said short axial dimension of said second boss is appropriately selected with respect to cables having said different diameter.

17. A cable strain relief assembly for an electrical connector having extending therefrom a plurality of electrical conductor cables terminated to terminals of the connector, for relieving strain on the terminations transmitted by the array of conductor cables, comprising:

a connector including therein a plurality of terminals terminated to respective conductor cables, said cables extending in an array rearwardly from a cable face of said connector;

cover means extending rearwardly from a forward end at said connector cable face and along said array of conductor cables;

means for clamping said cable array; and means securable to said cover means proximate said forward end for fastening said cover means to said connector, said fastening means comprising flange means of said cover means along lateral sides thereof at said forward end, clip means associated with each said flange means, and a pin associated with each said flange means and said clip means;

said connector including a pin-receiving hole associated with each said flange means and extending to said cable face aligned with a corresponding hole of an associated said cover flange means, each said pin-receiving hole having a selected diameter, said connector including a slot extending transversely from a side surface intersecting said pin-receiving hole;

each said clip means having respective sections adapted to be secured to said connector and to a respective said flange means including holes through transverse portions thereof aligned with each other, each said connector-securable clip section includes a transverse free end having therethrough a hole smaller in diameter than said pin-receiving hole diameter, said transverse clip free end being insertable into said connector slot from said side surface such that said smaller clip section hole aligns with said pin-receiving hole; and each said pin being insertable from rearwardly of said flange means through aligned holes of said flange means, said respective clip sections and said connector, and each said pin having a bifurcated enlarged leading end having a rearwardly facing stop surface, said leading end having a diameter smaller than said pin-receiving hole diameter and larger than the diameter of said hole of said transverse clip free end, said pin leading end being adapted to be reduced in diameter during insertion through said smaller diameter clip section hole by bifurcated pin portions being deflectable together thereby, and said stop surface stoppingly engages a forward surface of said transverse free end of said clip means after said pin leading end passes through said smaller diameter clip section hole when said deflected bifurcated pin portions resile forwardly of said transverse free end, whereby upon insertion of said pin leading ends through respective said holes of said flange means, said flange-securing clip section and said connector, and through said smaller diameter clip section hole and into a portion of said pin-receiving hole forwardly of said slot, said pin secures said clip means and flange means to said connector thereby fastening said cover means to said connector.

18. A cable strain relief assembly as set forth in claim 17 wherein each said flange means comprises spaced apart forward and rearward flanges and each said flange-securing clip section comprises a forward transverse portion to extend between said forward and rearward flanges from a first side, an axial portion to extend axially along a second opposing side of said rearward flange, and a transverse free end to extend along a rearward surface of said rearward flange, whereby said flange-securing clip section and said forward and rearward flanges increase resistance of said cover means to forces applied to the assembly from said first or second sides after being fastened to said connector.

* * * * *